United States Patent [19]

Smith

[11] Patent Number: 4,546,754

[45] Date of Patent: Oct. 15, 1985

[54] YOKE ANCHOR FOR COMPOUND BOWS

[75] Inventor: Max D. Smith, Evansville, Ind.

[73] Assignee: Indian Industries, Inc., Evansville, Ind.

[21] Appl. No.: 497,021

[22] Filed: May 23, 1983

[51] Int. Cl.[4] ..... F41B 5/00

[52] U.S. Cl. ..... 124/86

[58] Field of Search ..... 124/23 R, 24 R, DIG. 1, 124/90, 86

[56] References Cited

U.S. PATENT DOCUMENTS

| | | | |
|---|---|---|---|
| 4,050,137 | 9/1977 | Carlson . | |
| 4,054,118 | 10/1977 | McKee et al. | 124/23 R |
| 4,064,862 | 12/1977 | Grover . | |
| 4,300,521 | 11/1981 | Schmitt . | |
| 4,333,443 | 6/1982 | Roelle . | |
| 4,337,749 | 7/1982 | Barna | 124/DIG. 1 X |
| 4,353,346 | 10/1982 | Barna | 124/24 R |

*Primary Examiner*—Richard J. Apley
*Assistant Examiner*—William R. Browne
*Attorney, Agent, or Firm*—Woodard, Weikart, Emhardt & Naughton

[57] ABSTRACT

A yoke anchor for a compound bow is described which includes a semi-circular yoke portion having a perimetric groove for reception of the yoke cable affixed to the end of the bow limb and a central groove for reception of a terminal loop on the inside cable to be attached. A hook portion extends from one surface of the generally planar yoke portion and receives the other inside cable therein to cause the anchor and first inside cable to be pulled away from the bow string, thereby minimizing the chance of the bow string slapping against the yoke anchor or the inside cables during use.

8 Claims, 6 Drawing Figures

YOKE ANCHOR FOR COMPOUND BOWS

BACKGROUND OF THE INVENTION

1. Field of the Invention

The present invention relates to the field of compound bows, and more particularly to the field of yoke anchors for the inside cables of a compound bow.

2. Description of the Prior Art

The basic design and construction of compound bows is well understood in the art. These bows use cables which extend over eccentric pulleys mounted at the tips of the bow limbs to provide a mechanical advantage during the draw back of the bow string. The cable includes a central portion for reception of the arrow, and also includes inside cable portions which extend over the pulleys and typically cross over and attach to the opposite bow limb.

Various methods and devices have been proposed for attaching the inside cables to the opposite bow limbs. Some approaches have been quite straightforward, with the inside cables simply being attached to the bow limb, such as by direct attachment to a bolt affixed to the limb. An example of this type of inside cable attachment is described in U.S. Pat. No. 4,050,137, issued to Carlson on Sept. 27, 1977. Other versions have provided means for attaching the inside cables to the tip of the opposite bow limb, typically by means of a yoke member attached to the axle upon which the eccentric pulley is rotatably mounted.

In U.S. Pat. No. 4,300,521, issued to Schmitt on Nov. 17, 1981, there is disclosed a compound bow which includes a yoke anchor for mounting the inside cable to the opposite bow limb. This yoke anchor comprises a circular disc having a circumferential groove and a central aperture. A cable is attached at each end to the pulley axle and extends around the groove of the disc. The inside cable from the opposite limb extends through the central aperture of the disc and is thereby fastened to the anchor. This design is a simple one which provides for connection of the inside cable to the bow limb, but which does not serve any other function.

A similar yoke anchor is described in U.S. Pat. No. 4,064,862, issued to Groner on Dec. 27, 1977. A variation of this type of anchoring system is disclosed in U.S. Pat. No. 4,333,443, issued to Roelle on June 8, 1982. In the Roelle patent there is shown an anchor which, rather than a yoke configuration, is simply a J-shaped bracket which mounts to the eccentric axle on one side of the pulley and includes a slot within which the free end of the inside cable is received and attached.

Yoke anchors such as the one disclosed in the Schmitt patent adequately serve the purpose of connecting the inside cable to the bow limb. However, a disadvantage of such anchors is the possibility that the central cable portion, or bow string, may slap against either of the inside cables, or the yoke anchor. It is therefore desirable to provide a means for spacing the anchor and the inside cables away from the bow string.

In the prior art, this spacing has been accomplished by combining a yoke anchor as in the Schmitt patent with a second, separate piece which provides the desired spacing of the cables and anchor. For example, the Bear Archery subsidiary of Kidde, Inc., Gainseville, Fla., offers a bow under the designation "PRONGHORN HUNTER" which includes a two-piece anchor and separator system. The second piece comprises a connector which slidably joins the anchored inside cable with the other inside cable. The connector is secured to the anchored inside cable by connecting with the terminating loop of the cable which is received within the central aperture of the anchor disc. The connector further includes a portion which hooks over the other inside cable. The concept for these types of systems is that the other inside cable will pull the anchored cable, and the associated yoke anchor, off to one side and therefore away from the bow string.

SUMMARY OF THE INVENTION

Briefly describing one aspect of the present invention there is provided a yoke anchor for a compound bow which includes a yoke portion and a second portion extending outwardly therefrom. The yoke portion has first and second cable-receiving surfaces for receiving the yoke cable and the inside cable, respectively. The second portion includes a third cable-receiving surface for engaging the second inside cable in a sliding manner.

It is an object of the present invention to provide a yoke anchor for a compound bow, which anchor is of simple and inexpensive design.

Another object of the present invention is to provide a yoke anchor which includes a portion for being mounted to a bow limb tip by reception of a yoke cable extending about the anchor and connected at its free ends to the pulley axle.

It is a further object of the present invention to provide a yoke anchor which is readily mounted to a compound bow.

Another object of the present invention is to provide a yoke anchor which achieves all of the above purpose, and which particularly provides for maintaining the inside cables and the anchor displaced away from the bow string to avoid contact with the bow string during use of the bow.

Further objects and advantages of the present invention will become appararent from the description of the preferred embodiment which follows.

DESCRIPTION OF THE PREFERRED EMBODIMENT

Figure 1:
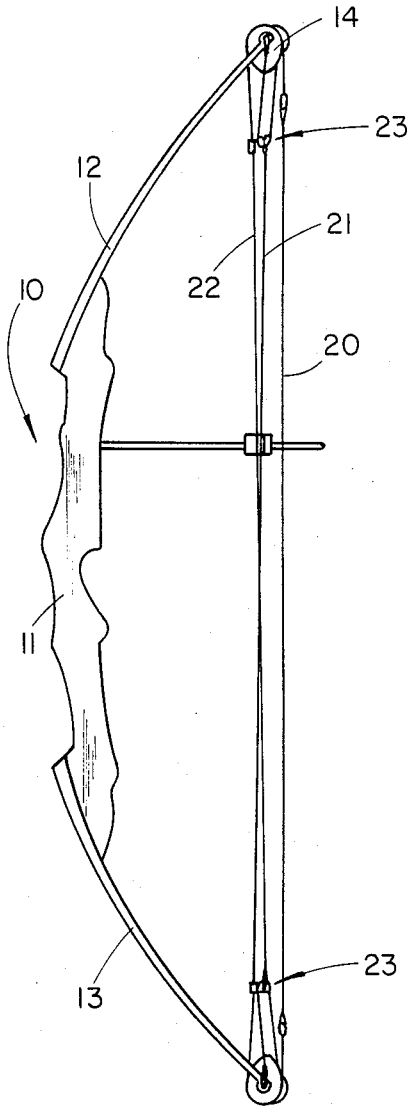
FIG. 1 is side elevational view of a compound bow including yoke anchors constructed in accordance with the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a yoke anchor useful in conjunction with certain types of compound bows in which the inside cables extend to opposite bow limbs and are attached thereto. The anchor provides for the anchoring of the inside cable with the bow limb, and also connects with the other inside cable to have the cables and anchor displaced from possible contact with the bow string.

Referring in particular to the drawings, there is shown a compound bow 10 having a handle portion 11 and outwardly extending bow limbs 12 and 13. Pulleys, such as 14, are eccentrically mounted on axles 15 mounted to the forks 16 and 17 of the limb tips. As will be further described, the present invention is useful with both the double and single pulleys used with compound bows. As shown in the drawings, the invention is described with respect to a double pulley including first pulley 18 and second pulley 19. The bow also includes a cable which includes a central cable, or bow string, portion 20 and end portions referred to herein as the inside cables 21 and 22.

The yoke anchor 23 includes a first, yoke portion 24 which preferably has a semi-circular shape. The yoke portion is generally planar with a perimetric edge that in the preferred embodiment includes a circularly-shaped portion and a linearly-shaped portion.

Figure 4:
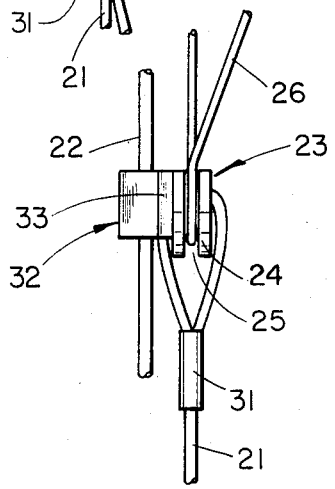
FIG. 4 is a side, elevational view of a yoke anchor of the present invention with the associated cables connected therewith.
Figure 5:
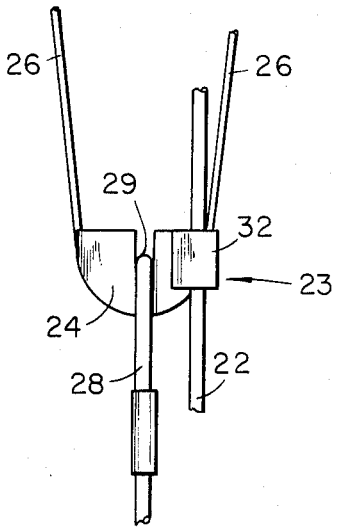
FIG. 5 is a rear, elevational view of the yoke anchor of FIG. 4.

The yoke portion defines a perimetric groove 25 (FIG. 4) forming a first cable-receiving surface against which the yoke cable 26 is received. The yoke cable 26 has free ends to which are secured eyelets, such as 27, which are received over the pulley axle 15 and retained thereon by snap rings 28. Alternately, the eyelets may be received on the axle on the inside of the tip forks 16 and 17 and are thereby retained on the axle.

The yoke portion further defines a second cable-receiving surface preferably defined by a groove 29 extending transverse of the linear edge of the semi-circular yoke portion. This surface is preferably located centrally to provide desired balance for the connection of the yoke anchor to the yoke cable and also to the inside cable secured thereby. The first inside cable 21 is anchored by securement to the yoke portion 24. Typically, the inside cable 21 is provided with a terminal loop 30 formed by doubling the free end over and connecting it back to the cable by means of a clasp 31. This yoke portion 24 is then partially inserted through the loop 30 to position the loop within the groove 29 as shown in the drawings. The yoke cable 26 is then threaded through the loop 30 and positioned within the perimetric groove 29, and finally is attached to the limb tip as described.

The yoke anchor 23 also includes a second portion 32 extending outwardly from one of the planar surfaces of the yoke portion 24 and attached thereto. The entire yoke anchor 23 may be readily and conveniently formed as a single, integral component out of a suitable plastic or other material. The second portion 32 defines a J-shaped, hook configuration having a surface against which is received the second inside cable 22. The inside cable 22 may be inserted into the hook portion 32 through the gap 33 between the yoke portion 24 and the spaced apart end of the hook portion. The relative positioning of the cable 22 and the orientation of the hook portion 32 causes the inside cable to be firmly pulled into the cavity of the hook portion and to be retained therein by the cable tension.

Figure 3:
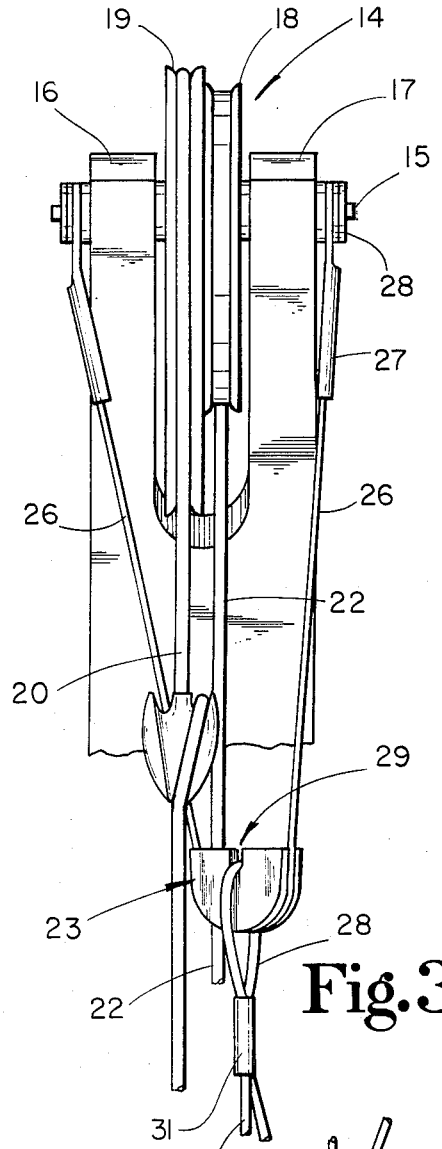
FIG. 3 is a front, elevational view of the limb tip of a compound bow having a yoke anchor mounted in accordance with the present invention.
Figure 2:
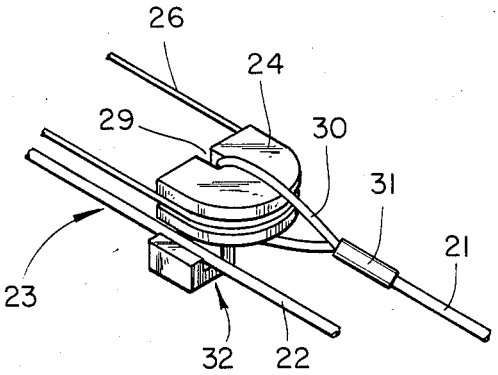
FIG. 2 is a perspective view showing a preferred embodiment of the present invention with the associated cable attachments.

In one preferred embodiment, the hook portion 32 is positioned off-center, outwardly of the second cable-receiving groove 29, and with the hook portion opening outwardly. This design is particularly adapted for use with the double pulley constructions of compound bows for the following reason. In these types of bows, the second inside cable 22 is displaced to one side of the bow string 20 since these two cable portions extend from different ones of the two pulleys (FIG. 3). Placement of the hook portion 32 on the side of the yoke portion 24 opposite the inside cable 22 will therefore cause the cable 22 to pull the anchor away from the bow string. In fact, the second inside cable 22 will cause the anchor 23 to be twisted or rotated in a direction away from the bow string, thereby increasing the separation between the anchor and the bow string. It will be appreciated that for this construction there are provided two different configuration of the yoke anchor which are mirror images of one another, to accomodate the mirrored configurations for the bow on the opposed limb tips.

Figure 6:
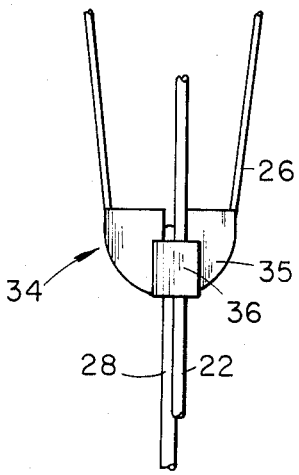
FIG. 6 is a rear, elevational view of a yoke anchor constructed in accordance with the present invention and showing an alternate location for the second, hook portion of the anchor.

An alternate embodiment of the yoke anchor of the present invention is shown in FIG. 6. Certain compound bows are now available which utilize only a single pulley. For such bows, it is preferred to locate the hook portion 32 at the center of the yoke portion 24 to maximize the separation between the yoke anchor and the bow string. For these types of bows, the twisting or rotating of the yoke anchor is not necessary, and may in fact be less desirable.

Referring in particular to FIG. 6, the alternate embodiment 34 is shown to have a yoke portion 35 which is essentially identical to the yoke portion 24 previously described. The hook portion 36 is also configured the same as the hook portion 32, except that it is located centrally of the yoke portion. The first inside cable again includes a terminating loop 28 which is received over the yoke portion in the manner already described. The only difference is that the loop 28 is now received also within the hook portion which may be provided with an enlarged gap or spacing from the surface of the yoke portion to facilitate insertion of both the inside cables into position. The second inside cable is also received within the hook portion as previously indicated.

It will be appreciated that the present invention provides a yoke anchor which is readily mounted to a variety of compound bows as presently available. The unit is simple and inexpensive in design, and serves several purposes without the need for two separate pieces being employed. In particular, the combination of the yoke and hook portions provides for attachment of a first inside cable with the limb tip while also slidingly receiving the second inside cable to pull the anchor and cables away from the bow string.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What I claim is:

1. A yoke anchor for securing a first inside cable of a compound bow to the tip of one of the bow limbs, the compound bow including a yoke cable connected at its free ends to the pulley axle, the compound bow further including a second inside cable extending adjacent the first inside cable proximate to the tip of the one of the bow limbs, said anchor comprising:

an integral anchor member including a generally planar yoke portion having first and second cable-receiving surfaces, the yoke portion having a first groove extending about a portion of the perimeter of the yoke portion and defining a first cable-receiving surface within which a yoke cable is received, the yoke portion further having a portion of a perimeter opposed to the first cable-receiving surface and defining a second cable-receiving surface against which a first inside cable is receivable, and a second portion attached to and extending outwardly from one of the planar surfaces of the yoke portion, the second portion defining a third cable-receiving surface configured to have a second inside cable slidingly receivable thereagainst.

2. The apparatus of claim 1 in which the yoke portion is semi-circular in shape having an arcuate perimetric edge portion and a linear perimetric edge portion, the first cable-receiving surface extending about the arcuate edge portion and the second cable-receiving portion being positioned centrally of the linear edge portion.

3. The apparatus of claim 1 in which the second portion of said anchor member comprises a hook portion extending outwardly of the surface of the yoke portion, the hook portion having a J-shaped cross section.

4. The apparatus of claim 3 in which the yoke portion is semi-circular in shape having an arcuate perimetric edge portion and a linear perimetric edge portion, the first cable-receiving surface extending about the arcuate edge portion and the second cable-receiving portion being positioned centrally of the linear edge portion.

5. The apparatus of claim 3 in which the second portion is located at about the center of the yoke portion and adjacent the second cable-receiving surface.

6. The apparatus of claim 5 in which the yoke portion is semi-circular in shape having an arcuate perimetric edge portion and a linear perimetric edge portion, the first cable-receiving surface extending about the arcuate edge portion and the second cable-receiving portion being positioned centrally of the linear edge portion.

7. The apparatus of claim 3 in which the second portion is displaced from the center of the yoke portion with the hook portion opening to the outside of the yoke portion.

8. The apparatus of claim 7 in which the yoke portion is semi-circular in shape having an arcuate perimetric edge portion and a linear perimetric edge portion, the first cable-receiving surface extending about the arcuate edge portion and the second cable-receiving portion being positioned centrally of the linear edge portion.

* * * * *